US007168211B2

(12) United States Patent
Prenn et al.

(10) Patent No.: US 7,168,211 B2
(45) Date of Patent: Jan. 30, 2007

(54) TUBULAR SKYLIGHT WITH DOME FLASHING AND PROTECTIVE WAFFLE PATTERN CORRUGATION

(75) Inventors: Joseph W. Prenn, San Diego, CA (US); David W. Rillie, Cardiff, CA (US); Christian P. Stevens, Oceanside, CA (US)

(73) Assignee: Solatube International, Inc., Vista, CA (US)

( * ) Notice: Subject to any disclaimer, the term of this patent is extended or adjusted under 35 U.S.C. 154(b) by 35 days.

(21) Appl. No.: 10/912,603

(22) Filed: Aug. 5, 2004

(65) Prior Publication Data

US 2005/0044808 A1 Mar. 3, 2005

Related U.S. Application Data

(63) Continuation-in-part of application No. 10/653,297, filed on Sep. 2, 2003.

(51) Int. Cl.
*E04D 13/03* (2006.01)
*E04B 7/18* (2006.01)

(52) U.S. Cl. ..... 52/200; 52/58; 52/219; 285/43

(58) Field of Classification Search ..... 52/199–200, 52/22, 72, 58–62, 97, 302.6, 218–219, 747.11, 52/726; 265/623; 285/42–44, 623
See application file for complete search history.

(56) References Cited

U.S. PATENT DOCUMENTS

| | | | | |
|---|---|---|---|---|
| 1,544,391 A | | 6/1925 | Budd et al. | 52/547 |
| 1,557,616 A | | 10/1925 | Riley | 52/547 |
| 2,641,204 A | | 6/1953 | Young | 52/546 |
| 3,124,427 A | * | 3/1964 | Chomes | 52/61 |
| 3,602,530 A | * | 8/1971 | Elwart | 285/4 |
| 3,646,717 A | | 3/1972 | Parker | 52/548 |
| 4,314,433 A | | 2/1982 | Hulcombe | 52/521 |
| 4,480,534 A | * | 11/1984 | Sloan | 454/182 |
| 4,635,409 A | * | 1/1987 | Vandemore | 52/60 |
| 4,664,390 A | * | 5/1987 | Houseman | 277/606 |
| 4,682,454 A | | 7/1987 | Simpson et al. | 52/200 |

(Continued)

FOREIGN PATENT DOCUMENTS

DE 2444280 * 3/1976

(Continued)

OTHER PUBLICATIONS

Newport Tool & Fastner Company, Inc. (date unknown).

*Primary Examiner*—Winnie Yip
(74) *Attorney, Agent, or Firm*—John L. Rogitz

(57) ABSTRACT

In a tubular skylight, an Aluminum sheet having corrugations that may be in a waffle pattern is formed with a hole that is pressed into a curb which is fastened over the turret of a roof-mounted skylight flashing. Roof tiles above the dome of the skylight are placed onto the sheet, while below the dome the sheet is placed over roof tiles and manually conformed thereto, owing to the corrugations. Any water that leaks past tiles above the dome will be directed by the sheet around the curb and down onto the tops of tiles that are below the dome, thereby providing a water seal for the skylight. Clips can be used to hold the lower edge of the sheet onto the tiles.

6 Claims, 3 Drawing Sheets

U.S. PATENT DOCUMENTS

| | | | | | |
|---|---|---|---|---|---|
| 4,730,426 | A | | 3/1988 | Weisner et al. | 52/200 |
| 4,965,971 | A | * | 10/1990 | Jean-Jacques et al. | 52/199 |
| 4,966,819 | A | * | 10/1990 | Schatz et al. | 428/603 |
| 5,010,700 | A | * | 4/1991 | Blair | 52/199 |
| 5,046,292 | A | * | 9/1991 | Sampson et al. | 52/200 |
| 5,053,266 | A | * | 10/1991 | Hesketh et al. | 428/192 |
| 5,099,622 | A | * | 3/1992 | Sutton | 52/200 |
| 5,226,263 | A | * | 7/1993 | Merrin et al. | 52/58 |
| 5,435,780 | A | * | 7/1995 | Ayles | 454/199 |
| 5,546,712 | A | * | 8/1996 | Bixby | 52/200 |
| 5,655,339 | A | * | 8/1997 | DeBlock et al. | 52/200 |
| 5,878,539 | A | * | 3/1999 | Grubb | 52/200 |
| 5,896,712 | A | * | 4/1999 | Chao | 52/200 |
| 5,896,713 | A | * | 4/1999 | Chao et al. | 52/200 |
| 6,212,834 | B1 | * | 4/2001 | Lindgren | 52/200 |
| 6,263,624 | B1 | * | 7/2001 | Hoy et al. | 52/200 |
| 6,813,864 | B2 | * | 11/2004 | Landis | 52/200 |
| 2003/0150175 | A1 | * | 8/2003 | Rillie | 52/200 |

FOREIGN PATENT DOCUMENTS

| | | | |
|---|---|---|---|
| DE | 19914071 | * | 10/2000 |
| EP | 38222 | * | 10/1991 |
| EP | 1008701 | * | 6/2000 |
| EP | 1281821 A1 | | 2/2003 |
| JP | 10-37410 | * | 2/1998 |
| JP | 11-306819 | * | 11/1999 |
| JP | 2004-52425 | | 2/2005 |
| WO | WO 94/00654 | * | 1/1994 |
| WO | WO 99/13180 | * | 3/1999 |

* cited by examiner

Fig.1
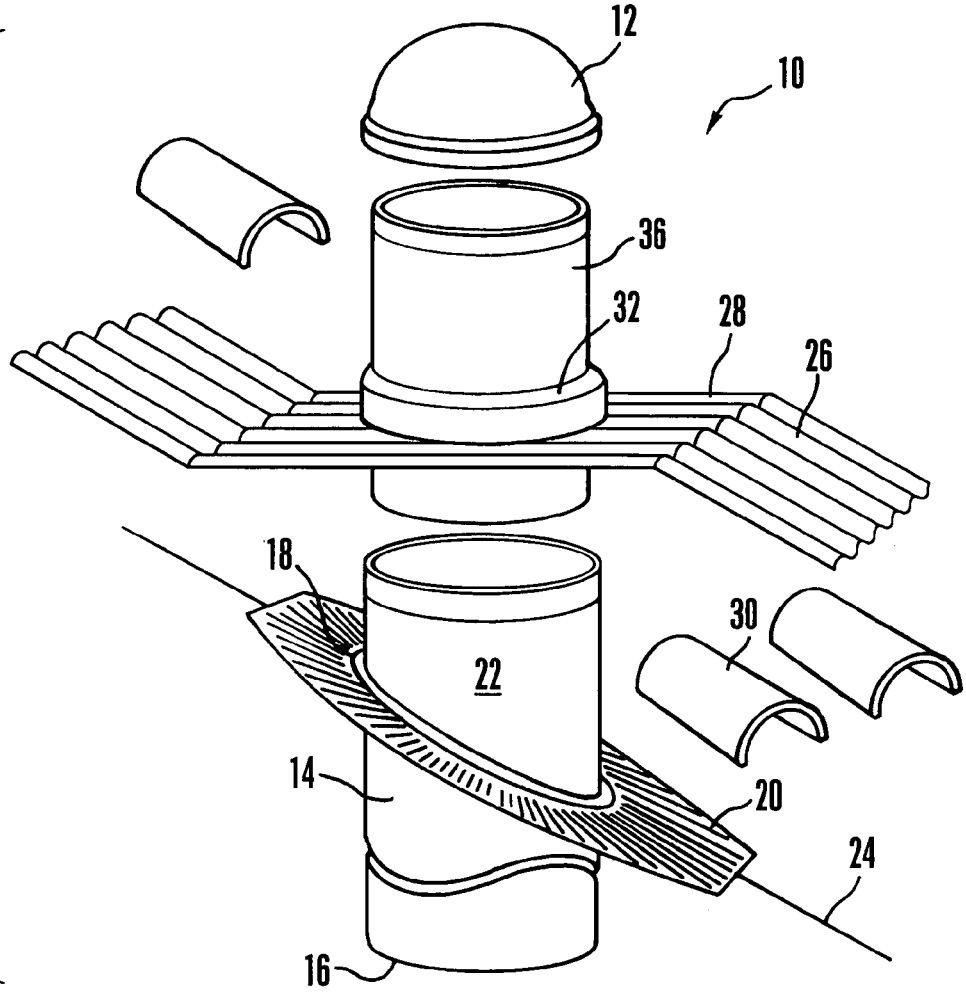
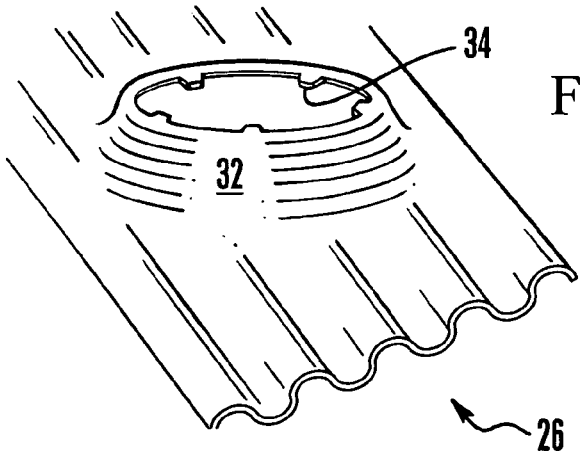
Fig. 2

TUBULAR SKYLIGHT WITH DOME FLASHING AND PROTECTIVE WAFFLE PATTERN CORRUGATION

RELATED APPLICATIONS

This is a continuation-in-part of co-pending U.S. patent application Ser. No. 10/653,297, filed Sep. 2, 2003, incorporated herein by reference.

FIELD OF THE INVENTION

The present invention relates to skylights.

BACKGROUND OF THE INVENTION

Skylights are used to illuminate buildings in a pleasing and energy-conserving way. Tubular skylights such as those made by the present assignee typically have a roof-mounted transparent cover or dome, a light conveying tube assembly extending down from the dome into the building to a ceiling, and a light diffuser plate covering the bottom of the tube at the ceiling.

To mount the dome on the roof, a flashing typically is provided. The flashing may have a flat skirt that is inclined to match the incline of the roof, and a cylindrical turret extending vertically upward from the skirt. The dome is fastened to the turret, with the tube assembly also engaging the turret to establish a single continuous light passageway through the dome and down into the tube assembly.

Many roofs are tiled. To install a skylight, some of the tiles typically are removed to expose the flat roof substrate, and the skirt of the flashing is then positioned over a hole that is cut into the roof substrate. The tiles are then replaced around the flashing.

The present invention is an improvement to prevent subsequent water leakage from the upper tile surface around the flashing/tile penetration down onto the roof substrate. As recognized herein, while previous solutions to this problem are not without utility, they can result in incomplete coverage through which water can flow. Moreover, the present invention recognizes that the previous use of lead pieces, used because of its malleability such that it can be conformed by hand around the tops of the lower tiles, entails structural and health risks. The present invention still further understands that rectangular multi-layer corrugated sealing pieces such as are disclosed in U.S. Pat. No. 6,503,601 not only fail to account for the above-noted geometric mismatch between tubular skylights and rectangular sealing pieces, but also require comparatively elaborate multi-layer construction.

SUMMARY OF THE INVENTION

A tubular skylight includes a transparent dome, a flashing coupled to the dome to mount the dome on a roof, and a skylight tube depending downwardly from the dome. The system also includes a sheet of corrugated metal mounted on the roof and coupled to the flashing. The sheet has a circular hole defining a periphery closely spaced from the flashing. Owing to the corrugations, the sheet is conformable to roof tiles to provide a water seal, as well as a rodent and insect barrier. The corrugations can include a first set of parallel corrugations and a second set of parallel corrugations, with the corrugations in the first set being orthogonal to the corrugations in the second set.

In a preferred embodiment, the sheet is formed with a curb circumscribing the hole, and the curb is coupled to the flashing. In one non-limiting implementation, the flashing defines an upper circular edge and bendable tabs extend radially inwardly from the curb of the sheet. The tabs may be bent over the edge to engage the sheet with the flashing without the need for fasteners. The sheet may be made of Aluminum, or it may be made of Copper, Lead, malleable Zinc, plastic, or rubber. Preferably, the corrugations of the sheet extend generally parallel to the incline of the roof when the sheet is mounted on the roof.

In another aspect, a method for mounting a tubular skylight includes receiving a corrugated single piece sheet defining a hole and a curb rising above and circumscribing the hole. The method further includes engaging the curb with a skylight flashing on a roof with an upper portion of the sheet being disposed underneath at least one roof tile above the flashing and with a lower portion of the sheet being disposed on top of at least one roof tile below the flashing. A skylight cover can then be coupled with the flashing. The corrugations may be in a waffle pattern.

In still another aspect, a lighting system includes a transparent skylight cover, a light diffuser, and a tubular structure extendable between the cover and diffuser. A single corrugated sheet is configured for circumscribing the tubular structure between the cover and the diffuser to impede water leakage through a roof above which the cover is to be disposed. The sheet has at least first and second elongated corrugations that are perpendicular to each other.

In another aspect, a device includes a corrugated single piece sheet defining a hole and a curb rising above and circumscribing the hole. The sheet has corrugations in a waffle pattern.

In still another aspect, a method for engaging a corrugated member with a tile roof includes disposing a corrugated metal sheet over at least two overlapping roof tiles, and fastening a leading edge of the sheet to at least one of the tiles. The sheet may be engaged with a skylight flashing on a roof, and a skylight cover can be coupled with the flashing. The method can include deforming the sheet to conform to at least one roof tile. The sheet can be fastened to the roof by sliding a leg of a clip between the tiles, and then bending a tab of the clip over the sheet. A fastener may then be disposed through at least the tab and sheet to hold the clip to the sheet.

In another aspect, a roof sealing system includes one or more clips, each formed with a first portion and a second portion. The system also includes a corrugated sealing member that is disposable over some roof tiles and under other roof tiles and that is generally conformable to the tiles. The first portion of each clip can be disposed between overlapping tiles and the second portion of each clip can be folded over an edge of the sheet to facilitate fastening the clip to the sheet.

In another aspect, a tubular skylight has a transparent dome, a flashing coupled to the dome to mount the dome on a roof, and a skylight tube depending downwardly from the dome. A sheet of corrugated metal is mounted on the roof and is coupled to the flashing. The sheet is conformable to roof tiles to provide a seal. The sheet may be made integrally with the flashing and may have one and only one set of parallel corrugations.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a partially exploded perspective view of the present skylight with corrugated sealing member, with portions cut away;

FIG. 2 is a perspective view of the corrugated sealing member;

DETAILED DESCRIPTION OF THE PREFERRED EMBODIMENT

Figure 3:
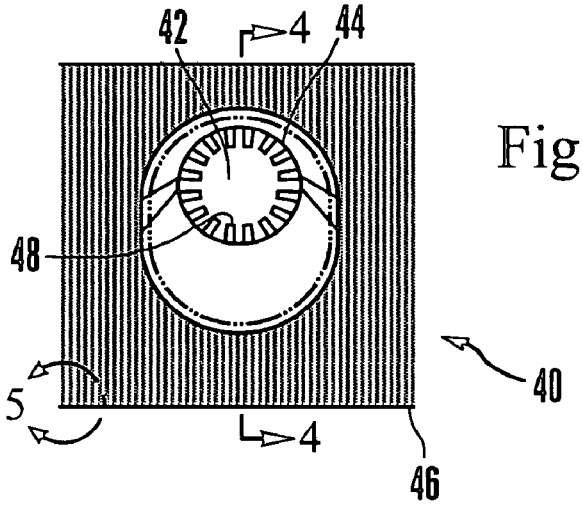
FIG. 3 is a top view of an alternate embodiment, showing a corrugated sheet having corrugations formed in a waffle pattern.
Figure 4:
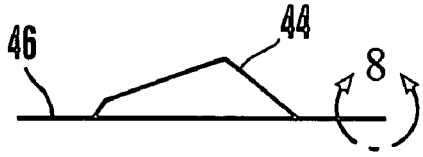
FIG. 4 is a cross-sectional diagram taken along the line 4—4 in FIG. 3.
Figure 5:
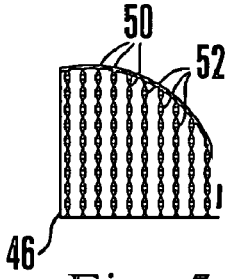
FIG. 5 is a detail view taken around the circle 5 shown in FIG. 3.
Figure 6:
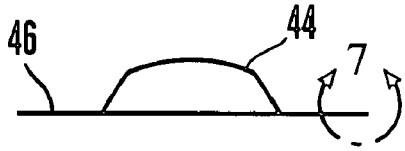
FIG. 6 is a side view of the embodiment shown in FIG. 3.
Figure 7:
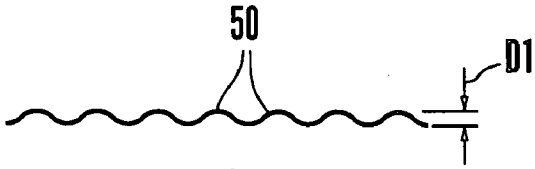
FIG. 7 is a detail view taken around the circle 7 shown in FIG. 6.
Figure 8:
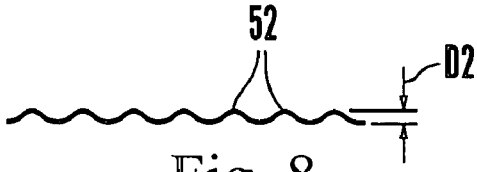
FIG. 8 is a detail view taken around the circle 8 shown in FIG. 4.

Referring initially to FIG. 1, a skylight is shown, generally designated 10, that includes a roof-mounted hard plastic transparent dome 12, an internally reflective light conveying tube assembly 14 covered by the dome 12, and a ceiling-mounted light diffuser plate 16 covering the bottom end of the tube assembly 14. The preferred skylight 10 is a tubular skylight. A metal flashing 18 having a flat skirt 20 and generally cylindrical turret 22 rising at an incline from the skirt 20 is mounted over a circular hole (not shown) that is cut into a roof 24 of a building by means known in the art to support the dome 12.

A preferably unitary single piece sheet 26 of corrugated metal such as Aluminum is mounted on the roof 24. As shown in FIG. 1, the sheet 26 is coupled to the flashing 18 in accordance with disclosure below. As can be appreciated in cross-reference to FIGS. 1 and 2, the sheet 26 has a circular hole formed in it which defines a periphery 28 that is closely spaced from the turret 22 of the flashing 18. In accordance with present principles, the sheet 26 is conformable to roof tiles 30, and in particular the sheet 26 conforms over the top of roof tiles 30 that are below the turret 22, to provide a seal.

With more specificity in reference to FIG. 1, the sheet 26 is formed with a cylindrical or frusto-conical shaped curb 32 that circumscribes the hole. To form the curb 32, a hole is cut into the sheet 26 and then the portion of the sheet 26 that is adjacent the hole to pressed into the curb configuration shown. Then, in the preferred embodiment as best shown in FIG. 2, the top of the curb 32 is bent inwardly to a horizontal orientation and then cut to define plural bendable tabs 34 for coupling the sheet 26 to the flashing 18. Specifically, the tabs 34, which extend radially inwardly from the curb 32 of the sheet 26, can be manually bent over the top edge of the flashing 18 to engage the sheet 26 with the flashing 18 without the need for fasteners.

With the above disclosure in mind, and now referring back to FIG. 1, tiles can be removed from the roof 24 and the flashing 18 positioned on the roof with the skirt 20 flat against the roof 24 as shown. Tiles 30 below the flashing 18 can be placed back on the roof 24. Then, the corrugated sheet 26 can be fitted over the turret 22 of the flashing 18, with the curb 32 of the sheet 26 circumscribing the turret 22. The tabs 34 can then be bent over the top edge of the turret 22, and tiles 30 above the flashing 18 replaced over the upper part of the sheet 26 as shown in FIG. 1. Preferably, the elongated corrugations defined by the sheet 26 extend generally parallel to the incline of the roof 24 as shown in FIG. 1 when the sheet 26 is mounted on the roof 24. In another embodiment, the corrugated sheet is made integrally with the skirt of the flashing, i.e., the corrugated sheet is established by corrugating the skirt (which is laid flush against the roof) of a flashing.

Next, if desired a flashing extension 36 can be fastened by, e.g., screws to both the dome 12 and the flashing 18 and/or curb 32 to couple the flashing 18 to the dome 12. The flashing extension 36 can be established by one or more tubes, and it may be made integrally with the flashing if desired. In any case, owing to the corrugations of the sheet 26, a person can easily deform the sheet 26 as necessary to generally conform to the tiles 30 that are below the dome 12 and that lie underneath the lower portion of the sheet 26.

With this invention, any water that leaks down past tiles 30 which are above the dome 12 will be directed by the sheet 26 around the curb 32 and down onto the tops of tiles 30 that are below the dome 12, thereby providing a water seal for the skylight 10.

Now referring to FIGS. 3–8, an alternate embodiment of the corrugated sheet is shown, generally designated 40. Like the sheet 26 shown in FIGS. 1 and 2, the sheet 40 shown in FIGS. 3–8 is made from a single piece of metal such as Aluminum and defines a hole 42 with a curb 44 rising above a flat portion 46 and circumscribing the hole 42. Plural bendable tabs 48 may be formed around the upper edge of the curb 44 for coupling the sheet 40 to a flashing such as the flashing 18 shown in FIGS. 1 and 2.

In accordance with the embodiment shown in FIGS. 3–8, the sheet 40 has corrugations formed in a waffle pattern. With specific reference to FIGS. 5, 7, and 8, the sheet 40 is formed, substantially throughout its surface, with a first set of parallel elongated corrugations 50 and a second set of elongated parallel corrugations 52, with the first set of corrugations 50 being substantially perpendicular to the second set of corrugations 52. In one non-limiting embodiment, the depth D1 from peak to trough of the first corrugations 50 may be one hundred twenty mils, whereas the depth D2 from peak to trough of the second corrugations 52 may be sixty mils. The corrugations 50, 52 may be roll-formed into a flat substrate to establish the corrugated sheet 40, with the shallower set of corrugations formed before the deeper set of corrugations.

With the waffle pattern shown in FIGS. 3–8, the sheet 40 may be readily bent as needed to assume, e.g., the curb configuration and other configurations.

Figure 12:
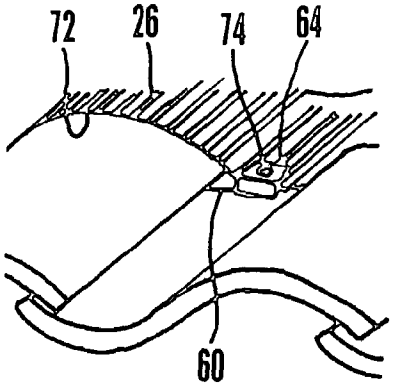
FIGS. 10–12 are perspective views illustrating how the clip shown in FIG. 9 can be used to hold the corrugated sealing member onto curved ("S") tiles, with portions of the roof cut away for clarity.
Figure 15:
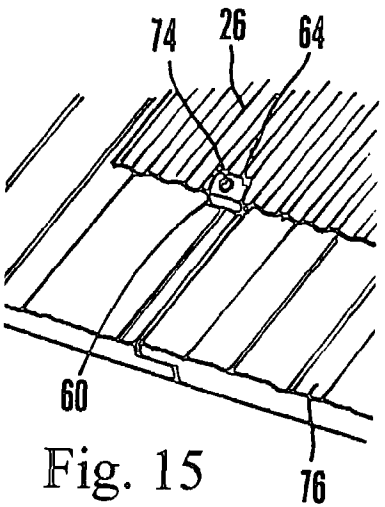
FIGS. 13–15 are perspective views illustrating how the clip shown in FIG. 9 can be used to hold the corrugated sealing member onto concrete tiles, with portions of the roof cut away for clarity.
Figure 14:
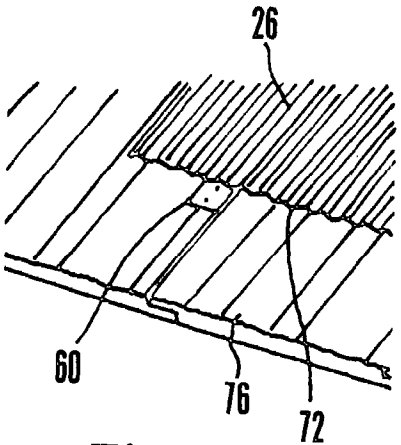
Figure 13:
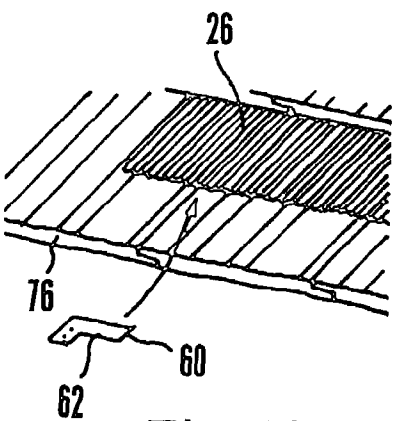

FIGS. 9–15 show one preferred non-limiting way to hold the corrugated sealing member of the present invention onto tile roofs. In the embodiments shown in FIGS. 9–15, a clip is used to hold the leading edge of a corrugated sealing member, such as the sheet 26 shown in FIG. 1, onto curved S-tiles (FIGS. 10–12) or flat concrete tiles (FIGS. 13–15). Preferably, plural clips are used.

Figure 9:
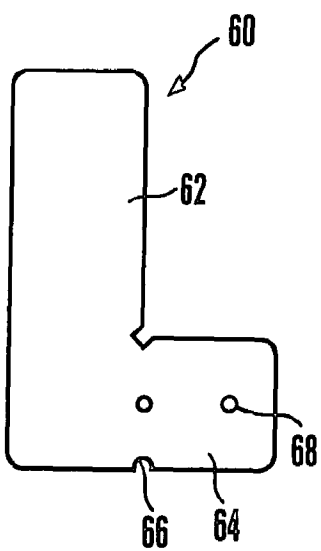
FIG. 9 is a plan view of a clip for holding the corrugated sealing member onto roof tiles.

With more specificity, FIG. 9 shows an L-shaped metal clip, generally designated 60, that has a relatively long leg 62 orthogonally and unitarily joining a shorter tab 64. A bend relief between the tab 64 and leg 62 can be established at least in part by notches 66 formed in the edge of the clip 60 as shown. Two fastener holes 68 may be formed in the clip 60, one in the upper center of the tab 64 as shown and the other more or less intermediate the notches 66.

Figure 11:
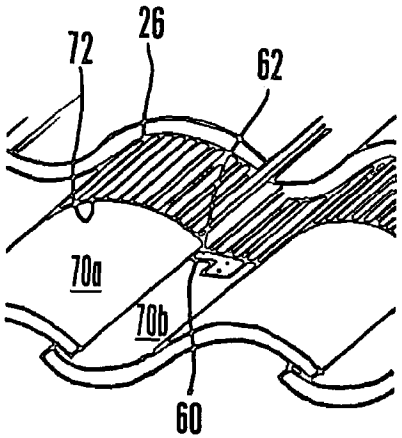
Figure 10:
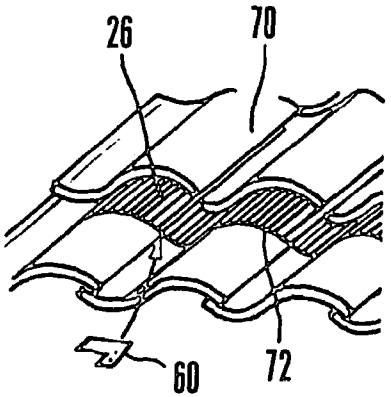

With the above clip structure in mind, reference is now made to FIGS. 10–12 to illustrate how the clip 60 holds the present corrugated sealing member onto a roof composed of plural overlapping curved "S"-tiles 70. As shown in cross-reference to FIGS. 9 and 10, the leg 62 of the clip 60 is slid under the leading edge 72 of the sheet 26 between overlapping tiles 70, i.e., the leg 62 is sandwiched between a bottom surface of a first tile 70*a* and a top surface of a second tile 70*b*. Next, as best shown in FIG. 12 the tab 64 is bent over the leading edge 72 of the corrugated sheet 26. In one embodiment the leading edge 72 is the lower-most edge (relative to the roof) of the sheet 26. It can be appreciated in reference to FIG. 12 that the tab 64 may be folded 90 E along the bend line defined between the notches 66 shown in FIG. 9, and then folded another 90 E along a bend line that is defined intermediate the screw holes 68. Then, a fastener such as a screw 74 can be disposed through the holes 68 and intervening corrugated sheet 26 to hold the clip 60 (the leg 62 of which is already held between overlapping tiles 70) onto the sheet 26. Plural clips 60 may be used along the length of the leading edge 72 of the corrugated sheet 26 to hold the leading edge 72 against the roof tiles.

FIGS. 13–15 show that the same clip 60 may be used in the same manner as described above to hold the leading edge 72 of the corrugated sheet 26 against flat concrete roof tiles 76 that overlap each other, i.e., the leg 62 of the clip 60 is slid between adjacent flat concrete tiles 76 and the tab 64 then folded over and fastened to the corrugated sheet 26 as set forth above.

It is to be understood that while the clip shown in FIG. 9 is a cost effective and convenient way to hold the present corrugated sealing member onto tile roofs to resist spring-back of the sealing member from the tiles as well as to resist wind loads and wind-driven rain that can separate the sealing member from the tiles, other fasteners can be used including, without limitation, adhesives and screws that can directly engage the corrugated member with one or more tiles.

While the particular TUBULAR SKYLIGHT WITH DOME FLASHING AND PROTECTIVE CORRUGATION as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. '112, sixth paragraph, unless the element is expressly recited using the phrase "means for" or, in the case of a method claim, the element is recited as a "step" instead of an "act". Absent express definitions herein, claim terms are to be given all ordinary and accustomed meanings that are not irreconciliable with the present specification and file history.

What is claimed is:

1. A tubular skylight, comprising:

a transparent dome;

a skylight tube depending downwardly from the dome;

a flashing coupled to the tube to mount the dome on a roof; and a sheet of corrugated metal mounted on the roof and coupled to the flashing, the sheet having a circular hole formed therein, the hole defining a periphery closely spaced from the flashing, the sheet being conformable to roof tiles to provide a seal, the sheet having a first set of plural parallel, straight corrugations and a second set of plural straight parallel corrugations crossing the first set, the corrugations in the first set being orthogonal to the corrugations in the second set.

2. The skylight of claim 1 wherein the sheet is formed with a curb circumscribing the hole, the curb being coupled to the flashing, the sheet and curb being a single unitary piece of metal.

3. A tubular skylight, comprising:

a transparent dome;

a skylight tube depending downwardly from the dome;

a flashing coupled to the tube to mount the dome on a roof; and a sheet of metal mounted on the roof and coupled to the flashing, the sheet having a circular hole formed therein, the hole defining a periphery closely spaced from the flashing, the sheet being conformable to roof tiles to provide a seal, the metal sheet having two sets of corrugations crossing each other, wherein the flashing defines an upper circular edge and the skylight further comprises plural bendable tabs extending radially inwardly from a curb of the sheet and being bendable over the edge to engage the sheet with the flashing without the need for fasteners.

4. The skylight of claim 3, further comprising a flashing extension coupling the flashing to the dome.

5. The skylight of claim 4, wherein the flashing extension is engaged with the dome and flashing using fasteners.

6. The skylight of claim 1, wherein the sheet is made of a single piece of material including at least one of: Aluminum, Copper, Lead, malleable Zinc.

* * * * *